US010470579B2

(12) United States Patent
Frady et al.

(10) Patent No.: US 10,470,579 B2
(45) Date of Patent: Nov. 12, 2019

(54) MULTI-USE SEAT

(71) Applicant: Cottonwood Outdoors, Corp., Jasper, GA (US)

(72) Inventors: George Frady, Jasper, GA (US); David Garner, Jasper, GA (US)

(73) Assignee: COTTONWOOD OUTDOORS, CORP., Jasper, GA (US)

( * ) Notice: Subject to any disclaimer, the term of this patent is extended or adjusted under 35 U.S.C. 154(b) by 0 days.

(21) Appl. No.: 15/618,853

(22) Filed: Jun. 9, 2017

(65) Prior Publication Data

US 2017/0354257 A1 Dec. 14, 2017

Related U.S. Application Data

(60) Provisional application No. 62/347,792, filed on Jun. 9, 2016.

(51) Int. Cl.

| | |
|---|---|
| ***A47C 9/10*** | (2006.01) |
| ***A47C 4/48*** | (2006.01) |
| ***A47C 4/52*** | (2006.01) |

(52) U.S. Cl.

CPC ..... *A47C 9/10* (2013.01); *A47C 4/48* (2013.01); *A47C 4/52* (2013.01)

(58) Field of Classification Search

CPC .... A47C 9/10; A47C 4/38; A47C 4/48; A47C 4/52

See application file for complete search history.

(56) References Cited

U.S. PATENT DOCUMENTS

| | | | | | |
|---|---|---|---|---|---|
| 1,695,374 | A * | 12/1928 | Harrison | A47C 9/10 | 4/237 |
| 2,015,560 | A * | 9/1935 | Iafrate | A47C 4/283 | 108/128 |
| 2,375,819 | A * | 5/1945 | Reid | A47C 9/10 | 108/115 |
| 2,982,455 | A * | 5/1961 | Rosen | A63B 55/00 | 224/155 |
| 3,122,397 | A * | 2/1964 | Mintz | A47C 4/283 | 248/164 |
| 3,871,482 | A * | 3/1975 | Southard | A01M 31/02 | 182/187 |
| 3,895,839 | A * | 7/1975 | Amato | A47C 3/32 | 297/26 |
| 5,522,642 | A * | 6/1996 | Herzog | A47C 3/38 | 248/188.2 |
| 6,000,752 | A * | 12/1999 | Shyr | A47C 4/38 | 297/129 |
| 9,332,852 | B1 * | 5/2016 | Milich | A47C 13/00 | |

(Continued)

*Primary Examiner* — Philip F Gabler

(74) *Attorney, Agent, or Firm* — Ballard Spahr LLP

(57) ABSTRACT

A seat, suitable for outdoor use, together with methods for preparing and using the same. The seat includes first and second structural members that can be pivotally coupled to each other at opposing first and second pivot points such that the first and second structural members can selectively rotate about and between open and closed positions. The seat also includes a seat covering positioned across at least a portion of the seating area between the first and second structural members such that the seat covering defines a continuous loop extending between the first and second structural members and wrapping around the top portions of the first and second structural members to define a seating surface.

18 Claims, 10 Drawing Sheets

(56) References Cited

U.S. PATENT DOCUMENTS

| | | | | |
|---|---|---|---|---|
| 2008/0012399 | A1* | 1/2008 | Lin | A47C 4/283<br>297/188.08 |
| 2018/0027970 | A1* | 2/2018 | Frankel | A47C 4/48 |

* cited by examiner

MULTI-USE SEAT

CROSS REFERENCE TO RELATED APPLICATIONS

This application claims the benefit of and priority to U.S. Provisional Patent Application No. 62/347,792, filed Jun. 9, 2016, which application is incorporated herein by reference in its entirety.

FIELD

The present disclosure relates to a multi-use seat, suitable for outdoor use, together with methods for the manufacture and use thereof.

BACKGROUND

Many conventional outdoor seating options can be cumbersome to transport and store. In addition, many outdoor seating options are uncomfortable to use for extended periods of time. Thus, there is a need to address the aforementioned problems and other shortcomings associated with conventional outdoor seating options. These needs and other needs can be satisfied by the articles, compositions, and methods of the present disclosure.

SUMMARY

In accordance with the purpose(s) of the invention, as embodied and broadly described herein, this disclosure, in one aspect, relates to a seat that can, for example, be used outdoors.

In another aspect, the present disclosure provides a foldable seat that can provide improved comfort over conventional seating options. More particularly, disclosed herein, in various aspects, is a seat comprising first and second structural members that can be pivotally coupled to each other at opposing first and second pivot points. The seat can be configured to selectively rotate about and between an open position and a closed position. Each structural member can include first and second leg portions and a top portion attached to and extending between the first and second leg portions. The first leg portion of the first structural member can be pivotally coupled to the first leg portion of the second structural member at the first pivot point. Similarly, the second leg portion of the first structural member can be pivotally coupled to the second leg portion of the second structural member at the second pivot point. The first and second structural members cooperate to define a seating area. The seat can also comprise a seating cover that can be positioned across at least a portion of the seating area between the first and second structural members. The seat covering can define a continuous loop extending between the first and second structural members and wrapping around the top portions of the first and second structural members to define a seating surface.

The accompanying figures, which are incorporated in and constitute a part of this specification, illustrate several aspects and together with the description serve to explain the principles of the invention.

Additional aspects of the invention will be set forth in part in the description which follows, and in part will be obvious from the description, or can be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE FIGURES

The accompanying figures, which are incorporated in and constitute a part of this specification, illustrate several aspects and together with the description serve to explain the principles of the invention.

DETAILED DESCRIPTION

Figure 1:
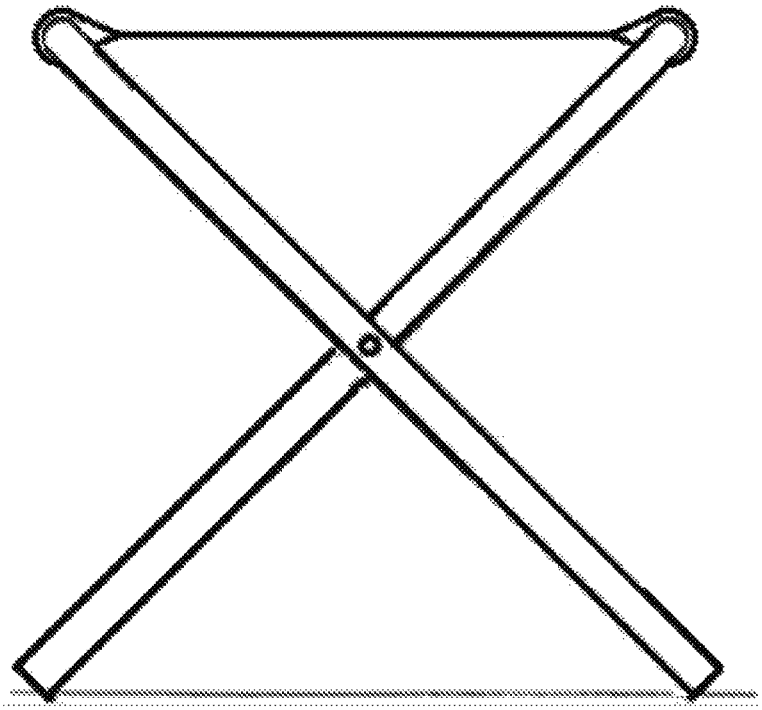
FIG. 1 PRIOR ART
FIG. 1 is a schematic illustration of a conventional folding seat.

The present invention can be understood more readily by reference to the following detailed description of the invention and the Examples included therein.

Before the present compositions, articles, systems, devices, and/or methods are disclosed and described, it is to be understood that they are not limited to specific methods of manufacture unless otherwise specified, as such can, of course, vary. It is also to be understood that the terminology used herein is for the purpose of describing particular aspects only and is not intended to be limiting. Although any methods and materials similar or equivalent to those described herein can be used in the practice or testing of the present invention, example methods and materials are now described.

All publications mentioned herein are incorporated herein by reference to disclose and describe the methods and/or materials in connection with which the publications are cited.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, example methods and materials are now described.

As used herein, unless specifically stated to the contrary, the singular forms "a," "an" and "the" include plural referents unless the context clearly dictates otherwise. Thus, for example, reference to "a tube" or "a ring" also includes aspects including two or more tubes, or rings, respectively.

As used herein, the terms "optional" or "optionally" means that the subsequently described event or circumstance can or can not occur, and that the description includes instances where said event or circumstance occurs and instances where it does not.

Disclosed are the components to be used to prepare the compositions of the invention as well as the compositions themselves to be used within the methods disclosed herein. These and other materials are disclosed herein, and it is understood that when combinations, subsets, interactions, groups, etc. of these materials are disclosed that while specific reference of each various individual and collective combinations and permutation of these components can not be explicitly disclosed, each is specifically contemplated and described herein. For example, if a particular component is disclosed and a number of modifications that can be made to the component are discussed, specifically contemplated is each and every combination and permutation of the component and the modifications that are possible unless specifically indicated to the contrary.

Each of the materials disclosed herein are either commercially available and/or the methods for the production thereof are known to those of skill in the art.

It is understood that the components disclosed herein can have certain functions. Disclosed herein are certain structural requirements for performing the disclosed functions, and it is understood that there are a variety of structures that can perform the same function that are related to the disclosed structures, and that these structures will typically achieve the same result.

Conventional folding seat designs, such as that illustrated in FIG. 1, typically utilize either a side to side configuration, wherein a fabric covering is disposed between structural components positioned to the left and right of a user when seated, or a front to back configuration, wherein a fabric covering is disposed between structural components positioned to the front and rear of a user when seated. Conventional front to rear seats can be uncomfortable, and after extended periods of use, can result in back or leg pain. As shown in FIG. 1, conventional folding seat designs can have a fabric covering loosely attached to the structural components, without forming a tight connection between the fabric and the structural components. Therefore, the fabric covering can shift, for example upwardly, reducing the level of comfortable and stability provided by the seat. In various aspects, the present disclosure provides an improved seat that can provide improved comfort and functionality over conventional seat designs.

Disclosed herein, in various aspects and with reference to FIGS. 2-12B, is a multi-purpose seat 10 that can be, for example, used in outdoor activities, such as, hunting and/or archery activities. In one aspect, the seat 10 is a folding seat that can be easily transported and stored. In another aspect, such a folding seat 10 can be easily deployed for use, without requiring tools or significant effort. In another aspect, the seat 10 comprises lightweight components, such that the seat can be transported easily. In another aspect, the seat 10 is collapsible, such that one or more components collapse and/or nest within or in registration with other components so as to minimize storage space and aide in transportation.

In one aspect, the seat 10 can comprise at least first and second structural members 20*a*, 20*b* that can be attached so as to rotate about a central axis 140. In one aspect, the first and second structural members 20*a*, 20*b* can be pivotally coupled to each other at opposing first and second pivot points 30*a*, 30*b*. In a further aspect, the first and second structural members 20*a*, 20*b* can selectively rotate about and between an open position and a closed position. In such an aspect, the first and second structural members 20*a*, 20*b* can be placed in a closed position such that a top portion 26*a*, 26*b* of one of the structural members 20*a*, 20*b* is parallel to and/or in registration with the top portion of the other structural member. Similarly, in the closed position, it is contemplated that the ends (e.g., a leg) of one structural member can be parallel to and/or in registration with the ends (e.g., a leg) of the other structural member. In another aspect, the first and second structural members 20*a*, 20*b* can be placed in an open position such that one of the structural members 20*a*, 20*b* is positioned at a seating area angle 120 relative to the other structural member. In this aspect, the seating area angle 120 formed between the first and second structural members 20*a*, 20*b* can be oriented upwardly relative to a vertical axis 110 and define a seating area 40. In another aspect, the seating area angle 120 formed between the first and second structural members 20*a*, 20*b* can be measured within a reference plane 130 that is perpendicular to an axis 140 extending through the first and second pivot points 30*a*, 30*b* of the seat 10.

In one aspect, the first and second structural members 20*a*, 20*b* can generally comprise an inverted U-shape, such that the ends of each of the first and second structural members 20*a*, 20*b* can contact the ground during use. Optionally, in such an aspect, one or more support members 100 can be attached to and extend between, for example, respective portions of the ends of each structural member 20*a*, 20*b*, so as to provide improved support and stability. It is contemplated that the one or more support members 100 can include a support bar, an arm, or the like.

In another aspect, the first and second structural members 20*a*, 20*b* can generally comprise a square, tubular, or rectangular shape. It should be understood that each structural member 20*a*, 20*b* can comprise a single piece or multiple pieces attached to form the structural member. It should also be understood that the shape of the first and second structural members 20*a*, 20*b* can vary. In one aspect, the first and second structural members 20*a*, 20*b* can comprise inverted U-shaped components wherein the center of the U is flat, substantially flat, or curved. In another aspect, the sides of an inverted U-shaped component can be curved or arching.

In yet another aspect, each structural member can have a top portion 26*a*, 26*b* (i.e., the center of the U-shaped component) and first and second leg portions 22*a*, 22*b*, 24*a*, 24*b* (i.e., the sides of the U-shaped component). In this aspect, the first and second leg portions 22*a*, 22*b*, 24*a*, 24*b* of each of the first and second structural members 20*a*, 20*b* can be symmetrical or substantially symmetrical relative to a reference plane 130 that extends through center points of the top portions 26*a*, 26*b* of the structural members. In these aspects, the top portion 26*a*, 26*b* of each structural member 20*a*, 20*b* can be attached to and extend between the first and second leg portions 22*a*, 22*b*, 24*a*, 24*b*. In a further aspect, the first leg portion 22*a* of the first structural member 20*a* can be pivotally coupled to the first leg portion 22*b* of the second structural member 20*b* at the first pivot point 30*a*. Similarly, the second leg portion 24*a* of the first structural member 20*a* can be pivotally coupled to the second leg portion 24*b* of the second structural member 20*b* at the second pivot point 30*b*. In these aspects, the first and second structural members 20*a*, 20*b* can cooperate to define the seating area 40.

It is contemplated that the first and second structural members 20*a*, 20*b* can comprise any material suitable for use in a seat that can provide the desired support and stability. In one aspect, the first and second structural members 20*a*, 20*b* can comprise a tubular material. In another aspect, the first and second structural members 20*a*, 20*b* can comprise a solid material. In another aspect, the first and second structural members 20*a*, 20*b* can comprise other geometries, such as, for example, square stock, an L or I frame shaped material, etc. The composition of the first and second structural members 20*a*, 20*b* can also vary, provided that the material can support the weight of a user and be durable. In various aspects, the first and second structural members 20*a*, 20*b* can comprise aluminum, steel, polyvinylchloride (PVC), acrylonitrile butadiene styrene (ABS), etc. In other aspects, the first and second structural members 20*a*, 20*b* can comprise other materials, such as polymeric materials, wood, metal materials, carbon fiber materials, etc., not specifically recited herein.

In another aspect, one or more of the structural members 20*a*, 20*b* can further comprise an extension portion (not shown) attached thereto or disposed therein. For example, a tubular structural member can comprise an extension portion comprised of a small diameter tubular material, wherein the extension portion can be disposed inside the structural member and can be optionally adjusted and secured. In such an aspect, the extension portion can be telescopically engaged in a structural member by, for example, a locking pin. It is contemplated that the extension portion can be used to selectively adjust the operative height of the seat 10.

The dimensions of each structural member 20*a*, 20*b* can be such that the seat 10 can be positioned on a surface, such as the ground, and a user can comfortably sit on the seat for an extended period.

Figure 6:
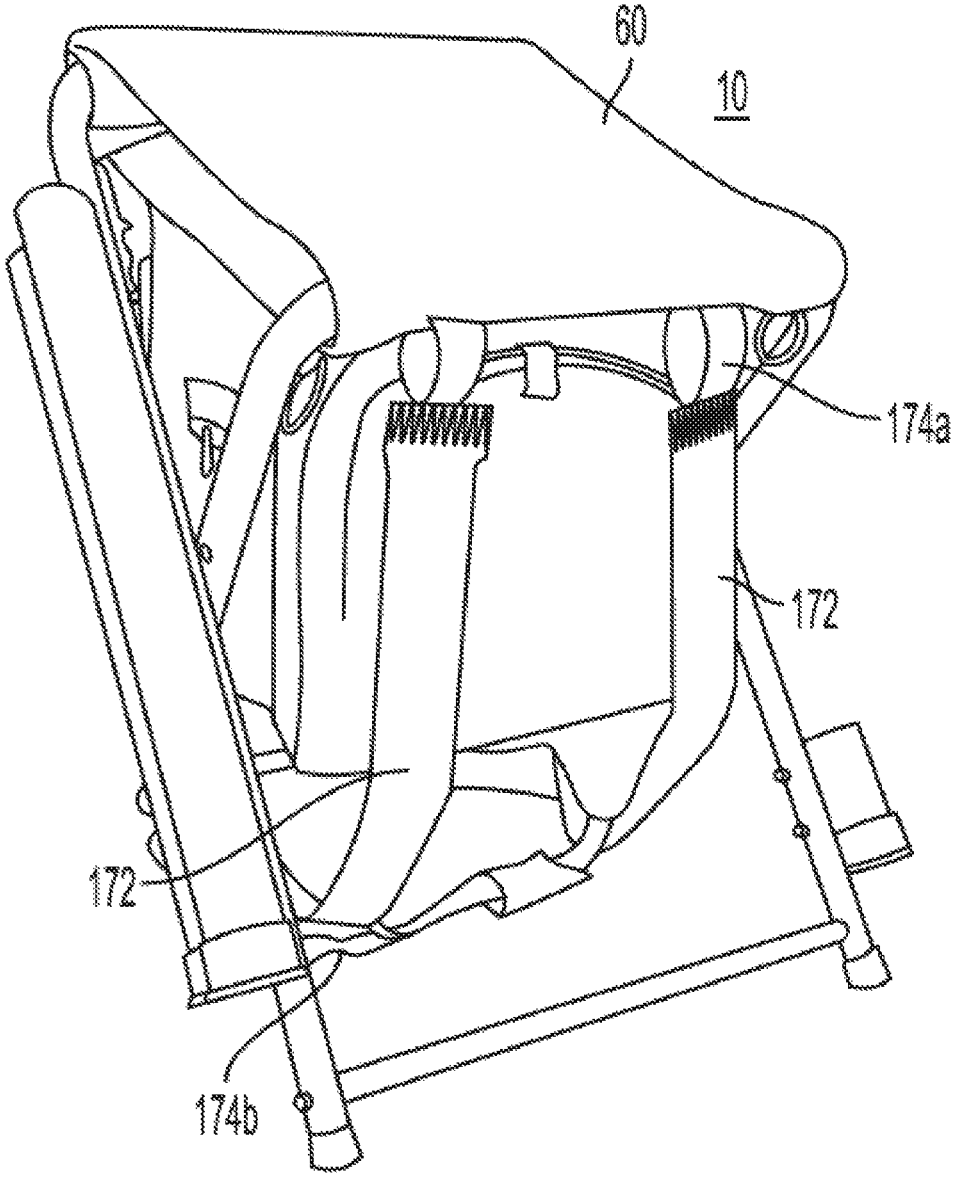
FIG. 6 is an image illustrating an exemplary folding seat in an open position, in accordance with various aspects of the present disclosure.

In one aspect, the first and second structural members 20*a*, 20*b* can comprise cooperating frame sections for the seat 10. In one aspect, the structural members 20*a*, 20*b* can be positioned in substantially overlying registration and attached to one another at at least one pivot point, for example, at the first and second pivot points 30*a*, 30*b* positioned on respective opposing sides of each structural member. In one example, each of the first and second structural members 20*a*, 20*b* is, for example, an inverted U-shaped tubular component (wherein the central portion of the U is flat) having the ends of the U-shaped component positioned towards the ground and the flat portion of the inverted U-shaped component positioned at elevation. The dimensions of one of the structural members 20*a*, 20*b* can be such that it can nest within or inside the area occupied by the other structural member. In one aspect, the first structural member 20*a* defines a first area 28*a* and the second structural member 20*b* defines a second area 28*b*. In another aspect, the second area 28*b* can be smaller than the first area 28*a*. Thus, in one aspect, the dimensions of one of the structural members 20*a*, 20*b* can be such that it can nest within or inside the area occupied by a larger structural member. For example, in one aspect, the first structural member 20*a* can defines a first area 28*a* and the second structural member 20*b* can define a second area 28*b* that is smaller than the first area. In this aspect, the second structural member 20*b* can be positioned within the first area 28*a* of the first structural member 20*a*. Alternatively, in another aspect, the first structural member 20*a* can define a first area 28*a* and the second structural member 20*b* can define a second area 28*b* that is larger than the first area. In this aspect, the first structural member 20*a* can be positioned within the second area 28*b* of the second structural member 28*a*. It is contemplated that the top portion and the first and second leg portions of each structural member can be generally oriented within a respective plane, within which the first area and/or second area is defined. In such aspects, the first and second pivot points 30*a*, 30*b* (where the structural members 20*a*, 20*b* are attached to one another) can be positioned at a predetermined fixed distance, for example, from the top/fabric portion of the seat or from the ground. It is not necessary that the first and second pivot points 30*a*, 30*b* be positioned the same distance from the ends of each component, and aspects wherein the pivot points are positioned at the same distance and at varying distances are both intended to be covered by this disclosure. The height of a structural member relative to the vertical axis 110 can also vary with respect to the other structural member. For example, in one aspect, the first structural member 20*a* can have a height that is greater than the height of the second structural member 20*b* relative to the vertical axis 110. In these aspects, such variations can provide a seat 10 having an angled seating surface 60, as shown in FIG. 6. In other aspects, the first and second pivot points 30*a*, 30*b* can comprise pins, bolts, or other means of attachment that can allow the first and second structural members 20*a*, 20*b* to move about the axis 140 extending through the first and second pivot points 30*a*, 30*b* from one side of the U to an opposing side. The extent to which the first and second structural members 20*a*, 20*b* can move can, in one aspect, be limited by the dimensions of a seat covering 50 attached to the first and second structural members 20*a*, 20*b*.

In another aspect, the seating area angle 120 is formed between the first leg portion 22*a* of the first structural member 20*a* and the first leg portion 22*b* of the second structural member 20*b*. In an exemplary aspect, the seat 10 can be in an open position and ready for use when the first and second structural members 20*a*, 20*b* are rotated relative to the axis 140 extending through the first and second pivot points 30*a*, 30*b* of the seat 10 such that the first structural member 20*a* cooperates with the second structural member 20*b* to define a seating area angle 120, measured within a reference plane 130 that is perpendicular to the axis 140 extending through the first and second pivot points 30*a*, 30*b* of the seat 10. As one can appreciate, in such an open position, the first and second structural members 20*a*, 20*b* can appear as an "X" in a side profile view. In other aspects, the specific seating area angle 120 formed between the first and second structural members 20*a*, 20*b* can vary, for example, from about 60 degrees to about 120 degrees, depending upon the desired application, seat covering, etc. Optionally, the seating area angle formed between the first and second structural members 20*a*, 20*b* can be about 90 degrees. In another aspect, the seat 10 can be in a closed position when the first and second structural members 20*a*, 20*b* are nested or positioned such that the first and second structural members 20*a*, 20*b* cooperate to form a seating area angle 120 of less than about 20 degrees, measured within the reference plane 130. It should also be noted that the specific angle in a closed or open position can vary, and the present disclosure is not intended to limit a particular angle.

In another aspect, the seat 10 comprises a seat covering 50 that can be positioned across at least a portion of the seating area 40 between the first and second structural members 20*a*, 20*b*. In this aspect, the seat covering 50 can define a continuous loop 52 that extends between the first and second structural members 20*a*, 20*b* and wraps around the top portions 26*a*, 26*b* of the first and second structural members 20*a*, 20*b* to define a seating surface 60. It is contemplated that the continuous loop 52 of the seat 10 can provide a more comfortable seat.

In a conventional folding seat, a seat covering is attached to and positioned between the structural members. In such a conventional folding seat, the structural member can apply pressure to the legs of a user upon seating. In contrast, the seat covering 50 of the present disclosure can comprise a continuous loop of material 52, starting over a front structural member (e.g., the first structural member 20*a*), across the seating area to the rear, over the rear structural member (e.g., the second structural member 20*b*), looping around the rear structural member underneath the seating surface 60, underneath the front structural member, and re-joining at the starting point. It should be understood that a continuous loop of material 52 can comprise one or more pieces attached together. In one aspect, the width of a seat covering 50 can comprise the distance needed to cover the side to side distance of the seating area 40. In another aspect, the seat covering 50 of the present disclosure does not merely attach to and hang from the first and second structural members.

Figure 2:
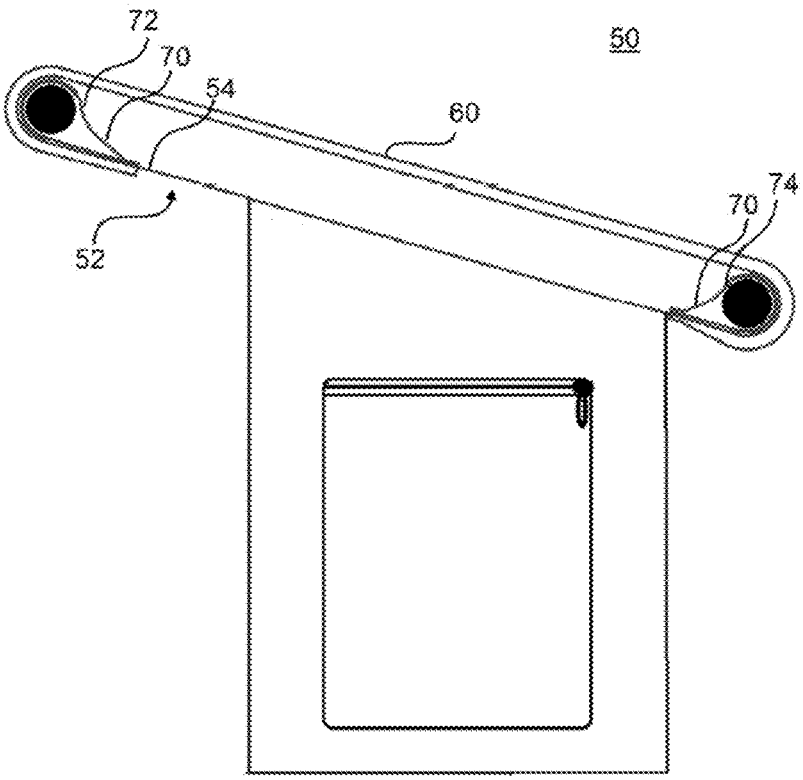
FIG. 2 is a schematic illustration of an exemplary folding seat, in accordance with various aspects of the present disclosure.

In another aspect, the seat covering 50 can further comprise at least one secondary loop 70, attached to an interior portion 54 of the continuous loop 52 and wrapping around the top portion of at least one structural member, as illustrated in FIG. 2. In this aspect, the at least one secondary loop 70 can secure the seat covering 50 to the structural members such that the secondary loop can prevent or reduce shifting of the seat covering 50 and/or the seat 10. In one aspect, such a secondary loop 70 can comprise a small width (e.g., 1 inch) of material. In another aspect, such a secondary loop 70 can comprise the width of the seat covering 50. In one aspect, such a secondary loop 70 can be positioned and affixed to one of the first and second structural members 20*a*, 20*b*. For example, the at least one secondary loop 70 can comprise a first secondary loop 72 that can be affixed to the first structural members 20*a*. In another aspect, the at least one secondary loop 70 can comprise a second secondary loop 72 that can be affixed to the second structural member 20*b*. It is contemplated that the at least one secondary loop 70 can comprise a plurality of secondary loops, which can be separately attached to each of the first and second structural members 20*a*, 20*b*. It has been found that such a seat covering design significantly improves comfort and minimizes pressure on the legs of a seated user.

Figure 3:
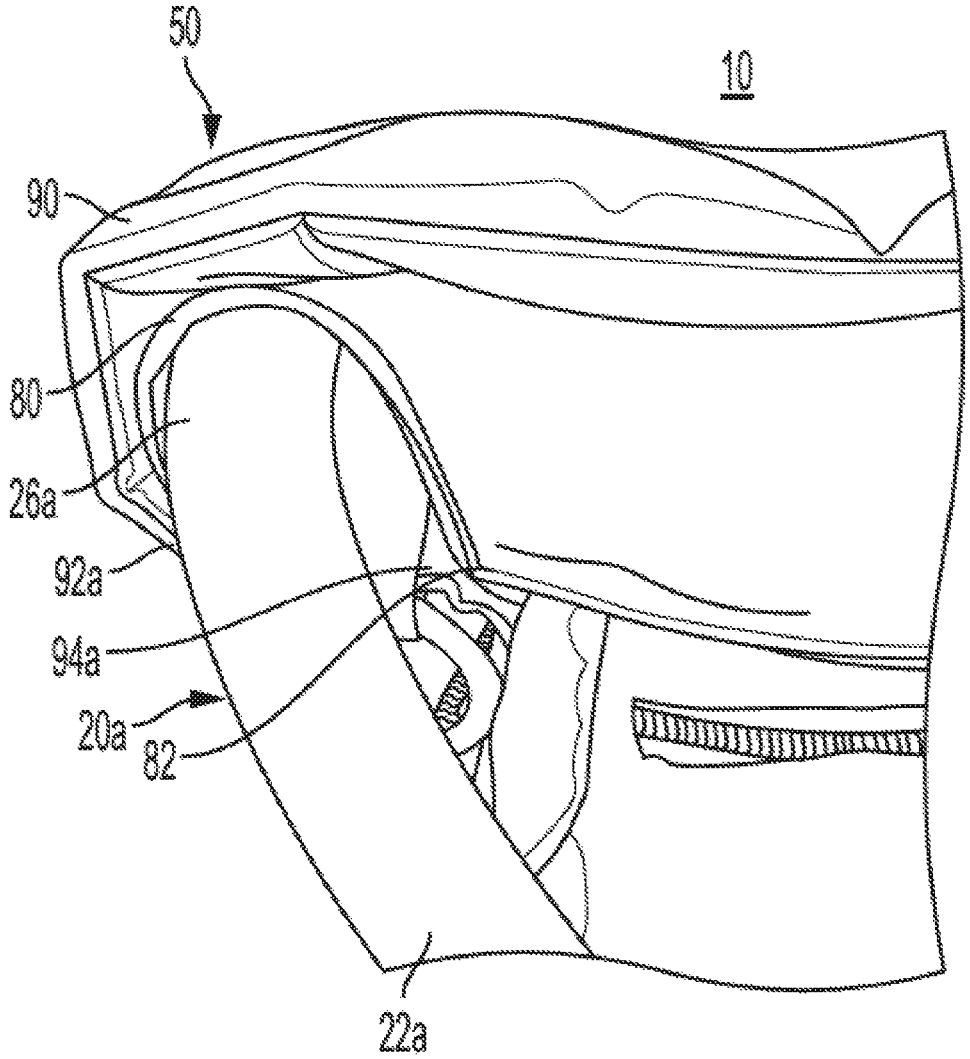
FIG. 3 is an image illustrating an exemplary seat covering and manner of attachment, in accordance with various aspects of the present disclosure.
Figure 4:
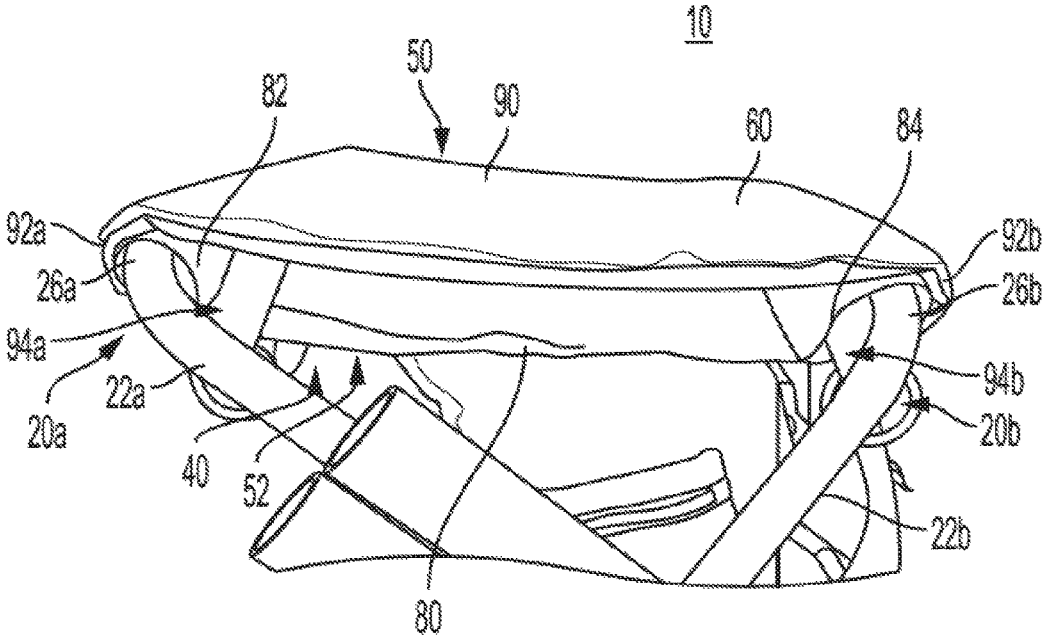
FIG. 4 is an image illustrating an exemplary seat covering and manner of attachment, in accordance with various aspects of the present disclosure.

In an alternative aspect, as shown in FIGS. 3-4, the seat covering 50 can comprise a first covering material 80 having opposite first and second ends 82, 84 and extending across the seating area 40 between the structural members 20*a*, 20*b*, wherein each end 82, 84 of the first covering material 80 is wrapped around a respective structural member and affixed to either itself (i.e., the first covering material) or to the structural member. For example, in one aspect, the first end 82 of the first covering material 80 can be wrapped around the top portion 26*a* of the first structural member 20*a*, and the second end 84 of the first covering material 84 can be wrapped around the top portion 26*b* of the second structural member 20*b*. In this aspect, the first and second ends 82, 84 of the first covering material 80 can be affixed to respective portions of the first covering material 80. Alternatively, the first and second ends 82, 84 of the first covering material 80 can be affixed to respective first and second structural member 20*a*, 20*b*. The seat covering 50 can comprise an outer covering material 90 having first and second ends 92*a*, 92*b*. Each end 92*a*, 92*b* of the outer covering material 90 can be attached to an underside of the first covering material 80 at respective first and second attachment points 94*a*, 94*b*. In one aspect, the first end 92*a* of the outer covering material 90 can be attached to the underside of the first covering material 80 at the first attachment point 94*a* (e.g., at the point the first covering material is attached to itself). The outer covering material 90 can then be wrapped around the outside of the first structural member 20*a*, across the top of the seating area 40, over and around the second structural member 20*b*, and then the second end of the outer covering material can be attached to the underside of the first covering material at the second attachment point 94*b* (e.g., the opposing end of the first covering material). In such an aspect, the combination of the first covering material 80 and the outer covering material 90 forms a continuous loop 52 across the seating area 40, over the structural members 20*a*, 20*b*, and underneath the seating surface 60, without any attachment points being in direct contact with a seated user. It has been found that such a seat covering design significantly improves comfort and minimizes pressure on the legs of a seated user.

Use of the secondary loops 70 is intended to secure and stabilize the seat covering 50, and to prevent undesirable rotation or movement of the seat covering during transport or use. Thus, in exemplary aspects, the disclosed seat 10 in combination with the secondary loops 70 and/or the first covering and outer covering materials 80, 90 can improve comfort, minimize pressure on the legs of a seat user, and prevent undesired movement of the seat.

The seat covering 50 can comprise any material suitable for use in a seat 10. In various aspects, the seat covering 50 can comprise a fabric or textile, a woven material, a non-woven material, or a flexible sheet-good. In one aspect, at least the outer portion of a seat covering 50 can be padded and/or quilted to provide further comfort for a user. In one aspect, a seat covering component can be rugged and durable for outdoor use. In another aspect, a seat covering component can be resistant to damage from moisture, UV irradiation, and temperature variations. In other aspects, any of the seat covering components can comprise a single color, multiple colors, and/or an image or pattern, such as, for example, a camouflage pattern.

Depending on the specific type of seat covering material employed, the method of attachment can vary. In various aspects, portions of the seat covering material can be sewn (i.e., stitched), glued, etc. It should also be understood that any seat covering component can comprise one or more layers of the same or varying material. For example, an outer seat covering material can comprise a first layer having enhanced tear resistance, an intermediate layer comprising a filler and/or padding material, and a third layer comprising a quilted fabric resistant to UV irradiation. In such an exemplary aspect, edges of the first and the third layers can be attached to form a padded outer seat covering material.

An additional benefit of the inventive seat design is improved strength and stability. In a conventional seat, the seat covering is attached to the structural members 20*a*, 20*b*, such that the structural members 20*a*, 20*b* carry the load applied to the seating area. In contrast, the seat covering 50 of the present disclosure provides a continuous loop of material, such that the seat covering material itself carries a significant portion of the load, and the first and second structural members 20*a*, 20*b* provide stability.

In other aspects, the seat 10 of the present disclosure comprises a modular design, such that one or more additional and optional components can be added, depending on the intended use. The specific method of attachment for any of the one or more additional and optional components can vary, for example, from screws, to bolts, to rivets, to spring loaded quick release fasteners.

Figure 5:
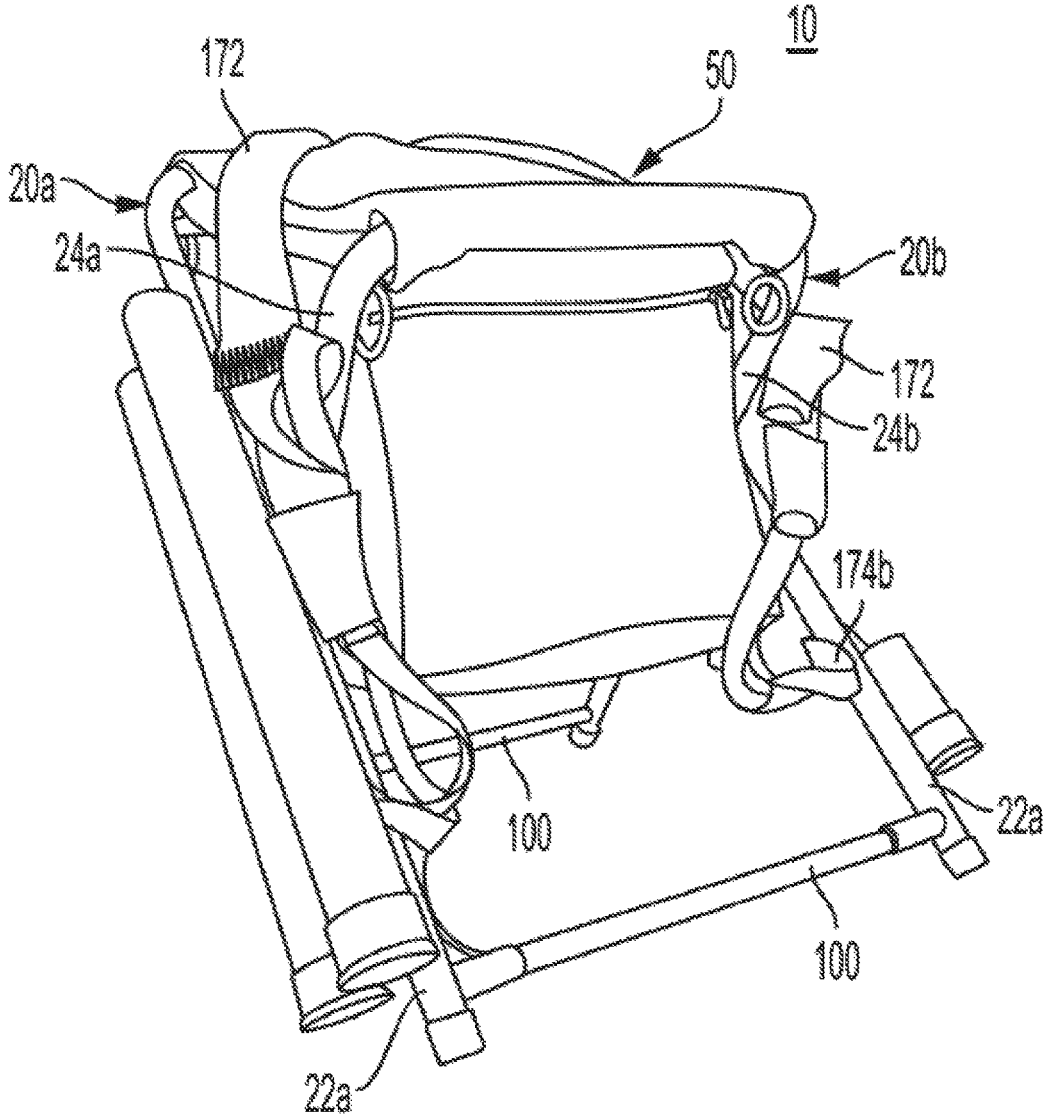
FIG. 5 is an image illustrating an exemplary folding seat in an open position, in accordance with various aspects of the present disclosure.

In one aspect, an umbrella holder 180 can be attached to at least one structural member, as shown in FIGS. 5-6. In an exemplary aspect, such an umbrella holder 180 can comprise a tube 182 attached to the structural member for holding the base of an umbrella, and a secondary strap 184 for securing a second point along the umbrella's shaft to the structural member.

Figure 7:
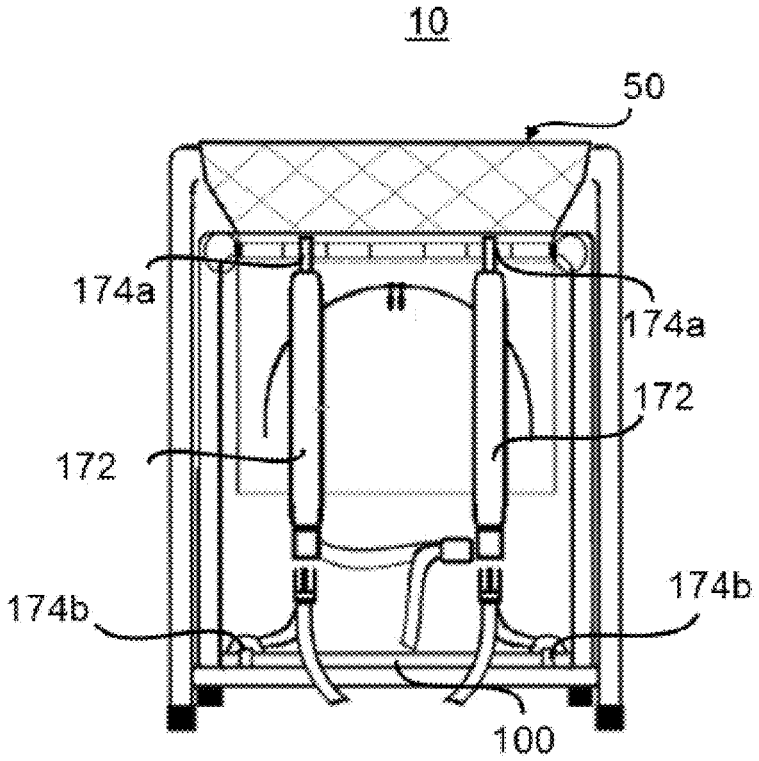
FIG. 7 is a schematic illustration of an exemplary folding seat in a closed position, the seat having a pair of shoulder straps coupled to the folding seat, in accordance with various aspects of the present disclosure.
Figure 8:
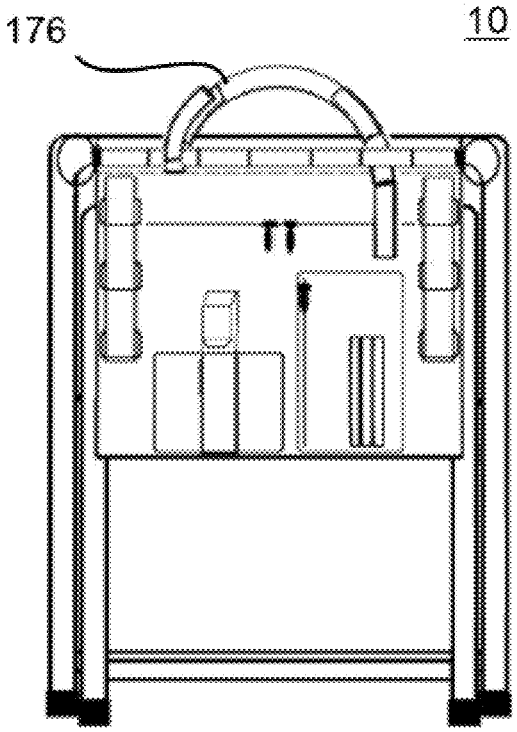
FIG. 8 is a schematic illustration of an exemplary folding seat in a closed position, the seat having a handle coupled to the folding seat, in accordance with various aspects of the present disclosure.

In a similar fashion, one or more quiver tubes 190 can be attached to at least one structural member for holding arrows when the seat 10 is used for archery activities, as shown in FIGS. 5-6. Also in similar fashion, a bow holder 200 can be attached to one of the structural members 20*a*, 20*b*. In similar fashion, a carry strap 170 can be connected to a portion of the structural members 20*a*, 20*b* and/or the seat covering material, to facilitate easy transport. In an exemplary aspect and as shown in FIG. 7, the carry strap 170 can be at least one shoulder strap 172 (e.g., a strap or pair of straps) affixed, for example, to the front or rear of the seat 10, such that the seat can be folded and carried on a user's back. In one aspect, it is contemplated that the at least one shoulder strap 172 can be attached to any portion of the first and second structural members 20*a*, 20*b* and/or the seat covering 50 that would allow a user to carry the seat 10 as desired. For example, the at least one shoulder strap 172 can have a first end 174*a* and a second end 174*b*, and the first end of the shoulder strap can be attached to the seat covering 50 and the second end of the shoulder strap can be attached to at least one of the first and second structural members 20*a*, 20*b*. Alternatively, in another exemplary aspect, the carry strap 170 can be at least one handle 176 having opposing ends that are attached to a portion of at least one of the first and second structural members 20*a*, 20*b* and/or the seat covering 50, as shown in FIG. 8. In some exemplary, aspects, it is contemplated that the seat 10 can comprise a combination of various carry straps 170, including at least one shoulder strap and a handle. It is further contemplated that the length of the carry strap 170 can be adjusted for sizing purposes. In another aspect, a storage bag having one or more compartments can be affixed to the underside of the seat covering 50 material or to the structural members 20*a*, 20*b* to provide storage space. In various aspects, such bags and/or storage containers can comprise a shell bag, spent cartridge holder, game bag, cup holder, cooler, cell phone pocket, binocular or optics storage, etc. In another aspect, a back support 150 can be attached to at least one of the first and second structural members 20*a*, 20*b* and can extend between the first and second leg portions of the structural member to provide back and/or lumbar support during use.

Figure 9:
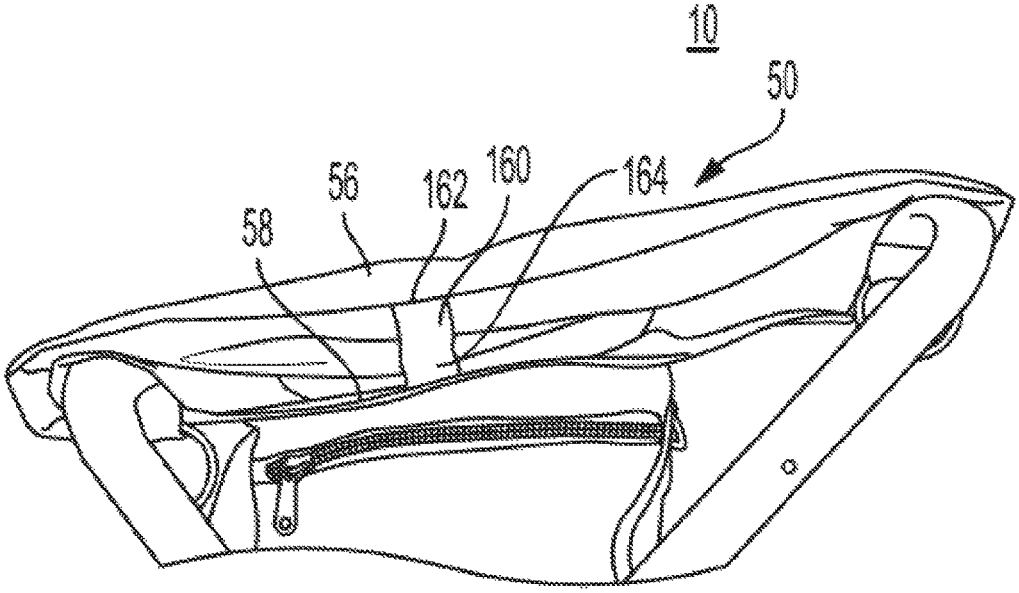
FIG. 9 is an image illustrating an exemplary seat covering having a pair of folding straps disposed on opposing sides of the seat covering between the first and second structural members, in accordance with various aspects of the present disclosure.
Figure 10:
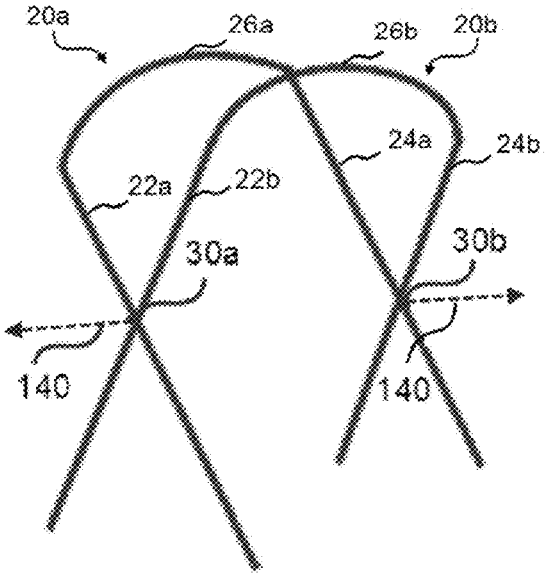
FIG. 10 is an isolated perspective view of an exemplary folding seat in an open position, showing first and second structural members pivotally coupled to each other at opposing first and second pivot points, in accordance with various aspects of the present disclosure. As shown, an axis extends horizontally through the first and second pivot points, as disclosed herein. The seat covering is not shown in FIG. 10.
Figure 11:
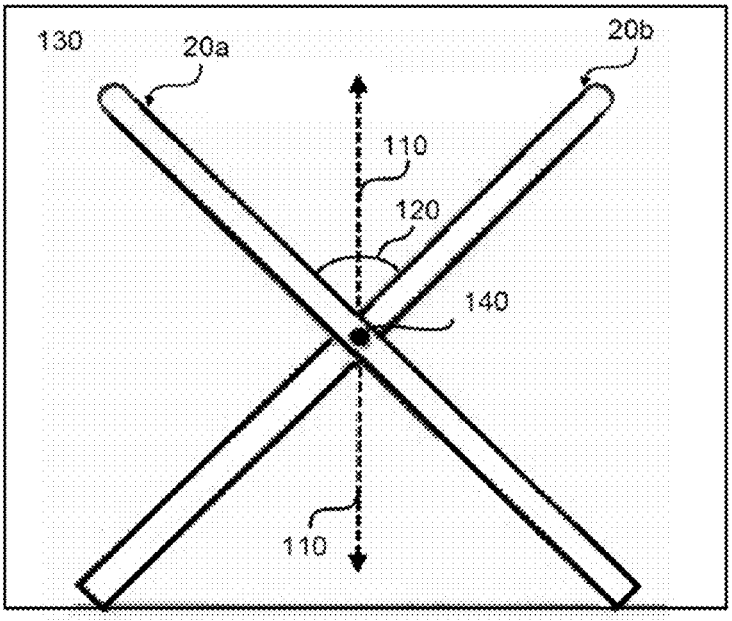
FIG. 11 is an isolated side view of an exemplary folding seat in an open position, showing a seating area angle and a reference plane that is perpendicular to an axis extending through the first and second pivot points, in accordance with various aspects of the present disclosure. The seat covering is not shown in FIG. 11.
Figure 12A:
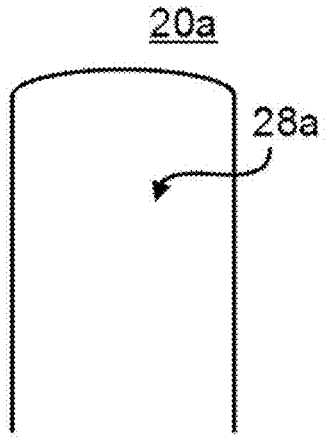
FIG. 12A is an isolated view of a first structural member having a first area.
Figure 12B:
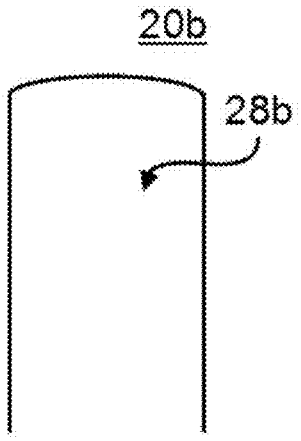
FIG. 12B is an isolated view of a second structural member having a second area. The seat covering is not shown in FIGS. 12A-12B.

In another aspect and with reference to FIG. 9, the seat 10 can include at least one pair of folding straps 160*a*, 160*b* disposed on opposing sides of the seat covering 50 between the first and second structural members 20*a*, 20*b*. In this exemplary aspect, each folding strap 160*a*, 160*b* can have a first end 162*a*, 162*b* and a second end 164*a*, 164*b*, and the first end 162*a*, 162*b* of each folding strap 160*a*, 160*b* can be attached to a top portion of the continuous loop 52 of the seat covering 50 and the second end 164*a*, 164*b* of each folding strap 160*a*, 160*b* can be attached to a bottom portion of the continuous loop 52 of the seat covering 50. In these exemplary aspects, the at least one pair of folding straps 160*a*, 160*b* are configured to fold the seat covering 50 inwardly when the folding seat 10 is in the closed position. In still other aspects, the seat 10 can comprise a plurality of attachment points, such as, for example. Molle strips, D-ring connectors, and the like. In yet other aspects, other components and/or accessories can be easily attached to the seat.

In one aspect, the modular design of the seat disclosed herein can facilitate re-configuration by an end-user. Such re-configuration can allow the same seat to be useful for multiple activities. In various aspects, such a seat could be useful for wingshooting, upload hunting, big-game hunting, etc., along with shooting and archery sport competitions.

EXEMPLARY ASPECTS

In view of the described products, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: A folding seat, comprising: first and second structural members pivotally coupled to each other at opposing first and second pivot points and configured to selectively rotate about and between an open position and a closed position, each structural member having first and second leg portions and a top portion attached to and extending between the first and second leg portions, the first leg portion of the first structural member being pivotally coupled to the first leg portion of the second structural member at the first pivot point, the second leg portion of the first structural member being pivotally coupled to the second leg portion of the second structural member at the second pivot point, wherein the first and second structural members cooperate to define a seating area; and a seat covering positioned across at least a portion of the seating area between the first and second structural members, wherein the seat covering defines a continuous loop extending between the first and second structural members and wrapping around the top portions of the first and second structural members to define a seating surface.

Aspect 2: The folding seat of aspect 1, wherein each structural member further comprises a support member attached to and extending between respective portions of the first and second leg portions.

Aspect 3: The folding seat of aspect 1, wherein the first and second leg portions of each of the first and second structural members are substantially symmetrical relative to a reference plane that extends through center points of the top portions of the structural members.

Aspect 4: The folding seat of aspect 1, wherein the first structural member defines a first area and the second structural member defines a second area that is smaller than the first area, and wherein the second structural member is configured to be positioned within the first area of the first structural member.

Aspect 5: The folding seat of aspect 1, wherein the first structural member defines a first area and the second structural member defines a second area that is larger than the first area, and wherein the first structural member is configured to be positioned within the second area of the second structural member.

Aspect 6: The folding seat of aspect 1, wherein, in the open position, the first structural member has a height that is greater than the height of the second structural member relative to a vertical axis, thereby providing an angled seating surface.

Aspect 7: The folding seat of aspect 1, wherein, in the open position, the first and second structural members cooperate to define a seating area angle ranging from about 60 degrees to about 120 degrees, and wherein the seating area angle is measured within a reference plane that is perpendicular to an axis extending through the first and second pivot points of the folding seat.

Aspect 8: The folding seat of aspect 7, wherein, in the closed position, the seating area angle is less than about 20 degrees.

Aspect 9: The folding seat of aspect 1, wherein the seat covering comprises one or more pieces attached together to form the continuous loop.

Aspect 10: The folding seat of aspect 1, wherein the seat covering further comprises at least one secondary loop attached to an interior portion of the continuous loop and wrapping around the top portion of at least one structural member of the first and second structural members.

Aspect 11: The folding seat of aspect 10, wherein the at least one secondary loop comprises a first secondary loop affixed to the first structural member.

Aspect 12: The folding seat of aspect 11, wherein the at least one secondary loop comprises a second secondary loop affixed to the second structural member.

Aspect 13: The folding seat of aspect 1, wherein the seat covering comprises a first covering material having opposite first and second ends and extending across the seating area between the first and second structural members, wherein the first end of the first covering material wraps around the first structural member and the second end of the first covering material wraps around the second structural member, wherein the first and second ends of the first covering material are affixed to at least one of the first covering material and the respective structural member.

Aspect 14: The folding seat of aspect 13, wherein the seat covering further comprises an outer covering material attached to an underside of the first covering material and wrapping around the top portions of the first and second structural members, and wherein the first covering material and the outer covering material cooperate to form the continuous loop across the seating area and around the structural members.

Aspect 15: The folding seat of aspect 1, wherein the seat covering comprises a material selected from the group consisting of a fabric, a woven material, a non-woven material, and a flexible sheet-good.

Aspect 16: The folding seat of aspect 1, further comprising a back support attached to at least one structural member and extending between the first and second leg portions of the at least one structural member.

Aspect 17: The folding seat of aspect 1, further comprising at least one pair of folding straps disposed on opposing sides of the seat covering between the first and second structural members, each folding strap having a first end and a second end, the first end of each folding strap attached to a top portion of the continuous loop of the seat covering and the second end of each folding strap attached to a bottom portion of the continuous loop of the seat covering, wherein the at least one pair of folding straps are configured to fold the seat covering inwardly when the folding seat is in the closed position.

Aspect 18: The folding seat of aspect 1, further comprising at least one shoulder strap having a first end and a second end, wherein the first end of the shoulder strap is attached to the seat covering and the second end of the shoulder strap is attached to at least one of the first and second structural members.

Aspect 19: A folding seat, comprising: first and second structural members pivotally coupled to each other at opposing first and second pivot points and configured to selectively rotate about and between an open position and a closed position, each structural member having first and second leg portions and a top portion attached to and extending between the first and second leg portions, the first leg portion of the first structural member being pivotally coupled to the first leg portion of the second structural member at the first pivot point, the second leg portion of the first structural member being pivotally coupled to the second leg portion of the second structural member at the second pivot point, wherein the first and second structural members cooperate to define a seating area; and a seat covering positioned across at least a portion of the seating area between the first and second structural members, wherein the seat covering defines a continuous loop extending between the first and second structural members and wrapping around the top portions of the first and second structural members to define a seating surface, the seat covering having at least one secondary loop attached to an interior portion of the continuous loop and wrapping around the top portion of at least one structural members.

Aspect 20. A folding seat, comprising: first and second structural members pivotally coupled to each other at opposing first and second pivot points and configured to selectively rotate about and between an open position and a closed position, each structural member having first and second leg portions and a top portion attached to and extending between the first and second leg portions, the first leg portion of the first structural member being pivotally coupled to the first leg portion of the second structural member at the first pivot point, the second leg portion of the first structural member being pivotally coupled to the second leg portion of the second structural member at the second pivot point, wherein the first and second structural members cooperate to define a seating area; and a seat covering positioned across at least a portion of the seating area between the first and second structural members, wherein the seat covering defines a continuous loop extending between the first and second structural members and wrapping around the top portions of the first and second structural members to define a seating surface, the seat covering comprising a first covering material having opposite first and second ends and extending across the seating area between the first and second structural members, wherein the first end of the first covering material wraps around the first structural member and the second end of the first covering material wraps around the second structural member, wherein the first and second ends of the first covering material are attached to at least one of the first covering material and the respective structural member, and an outer covering material attached to an underside of the first covering material and wrapping around the top portions of the first and second structural members, and wherein the first covering material and the outer covering material cooperate to form the continuous loop across the seating area and around the structural members.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A folding seat, comprising:

first and second structural members pivotally coupled to each other at opposing first and second pivot points and configured to selectively rotate about and between an open position and a closed position, each structural member having first and second leg portions and a top portion attached to and extending between the first and second leg portions, the first leg portion of the first structural member being pivotally coupled to the first leg portion of the second structural member at the first pivot point, the second leg portion of the first structural member being pivotally coupled to the second leg portion of the second structural member at the second pivot point, wherein the first and second structural members cooperate to define a seating area; and a seat covering positioned across at least a portion of the seating area between the first and second structural members, wherein the seat covering defines a continuous loop extending between the first and second structural members and wrapping around the top portions of the first and second structural members to define a seating surface, wherein the seat covering comprises a first covering material having opposite first and second ends and disposed across the seating area between the first and second structural members and defining a continuous surface that fully covers the seating area and extends between a first side and an opposing second side that extend transversely between the first and second ends, wherein the first end of the first covering material wraps around the first structural member and the second end of the first covering material wraps around the second structural member, wherein the first end of the first covering material is affixed to at least one of the first structural member and a first portion of the first covering material that is spaced from the first end of the first covering material, and the second end of the first covering material is affixed to at least one of the second structural member and a second portion of the first covering material that is spaced from the second end of the first covering material, wherein the seat covering further comprises an outer covering material attached to an underside of the first covering material at first and second attachment points that are spaced from the first structural member and the second structural member, extending across the seating area and wrapping around the top portions of the first and second structural members, and wherein the first covering material and the outer covering material cooperate to form the continuous loop across the seating area and around the structural members.

2. The folding seat of claim 1, wherein each structural member further comprises a support member attached to and extending between respective portions of the first and second leg portions.

3. The folding seat of claim 1, wherein the first and second leg portions of each of the first and second structural members are substantially symmetrical relative to a reference plane that extends through center points of the top portions of the structural members.

4. The folding seat of claim 1, wherein the first structural member defines a first area and the second structural member defines a second area that is smaller than the first area, and wherein the second structural member is configured to be positioned within the first area of the first structural member.

5. The folding seat of claim 1, wherein the first structural member defines a first area and the second structural member defines a second area that is larger than the first area, and wherein the first structural member is configured to be positioned within the second area of the second structural member.

6. The folding seat of claim 1, wherein, in the open position, the first structural member has a height that is greater than the height of the second structural member relative to a vertical axis, thereby providing an angled seating surface.

7. The folding seat of claim 1, wherein, in the open position, the first and second structural members cooperate to define a seating area angle ranging from about 60 degrees to about 120 degrees, and wherein the seating area angle is measured within a reference plane that is perpendicular to an axis extending through the first and second pivot points of the folding seat.

8. The folding seat of claim 7, wherein, in the closed position, the seating area angle is less than about 20 degrees.

9. The folding seat of claim 1, wherein the seat covering comprises one or more pieces attached together to form the continuous loop.

10. The folding seat of claim 1, wherein the seat covering further comprises at least one secondary loop attached to an interior portion of the continuous loop and extending around the top portion of at least one structural member of the first and second structural members.

11. The folding seat of claim 10, wherein the at least one secondary loop comprises a first secondary loop affixed to the first structural members.

12. The folding seat of claim 11, wherein the at least one secondary loop comprises a second secondary loop affixed to the second structural member.

13. The folding seat of claim 1, wherein the seat covering comprises a material selected from the group consisting of a fabric, a woven material, a non-woven material, and a flexible sheet-good.

14. The folding seat of claim 1, further comprising a back support attached to at least one structural member and extending between the first and second leg portions of the at least one structural member.

15. The folding seat of claim 1, further comprising at least one pair of folding straps disposed on opposing sides of the seat covering between the first and second structural members, each folding strap having a first end and a second end, the first end of each folding strap attached to a top portion of the continuous loop of the seat covering and the second end of each folding strap attached to a bottom portion of the continuous loop of the seat covering, wherein the at least one pair of folding straps are configured to fold the seat covering inwardly when the folding seat is in the closed position.

16. The folding seat of claim 1, further comprising at least one shoulder strap having a first end and a second end, wherein the first end of the shoulder strap is attached to the seat covering and the second end of the shoulder strap is attached to at least one of the first and second structural members.

17. A folding seat, comprising:

first and second structural members pivotally coupled to each other at opposing first and second pivot points and configured to selectively rotate about and between an open position and a closed position, each structural member having first and second leg portions and a top portion attached to and extending between the first and second leg portions, the first leg portion of the first structural member being pivotally coupled to the first leg portion of the second structural member at the first pivot point, the second leg portion of the first structural member being pivotally coupled to the second leg portion of the second structural member at the second pivot point, wherein the first and second structural members cooperate to define a seating area; and a seat covering positioned across at least a portion of the seating area between the first and second structural members at first and second attachment points that are spaced from the first structural member and the second structural member, wherein the seat covering defines a continuous loop extending between the first and second structural members and wrapping around the top portions of the first and second structural members to define a seating surface, the seat covering having a secondary loop attached to an interior portion of the continuous loop extending between the first and second structural members and wrapping around the top portions of the first and second structural members wherein the seat covering comprises a first covering material having opposite first and second ends and disposed across the seating area between the first and second structural members and defining a continuous surface that fully covers the seating area and extends between a first side and an opposing second side that extend transversely between the first and second ends, wherein the first end of the first covering material wraps around the first structural member and the second end of the first covering material wraps around the second structural member, wherein the first end of the first covering material is affixed to at least one of the first structural member and a first portion of the first covering material that is spaced from the first end of the first covering material, and the second end of the first covering material is affixed to at least one of the second structural member and a second portion of the first covering material that is spaced from the second end of the first covering material, wherein the seat covering further comprises an outer covering material attached to an underside of the first covering material, extending across the seating area and wrapping around the top portions of the first and second structural members, and wherein the first covering material and the outer covering material cooperate to form the continuous loop across the seating area and around the structural members.

18. A folding seat, comprising:

first and second structural members pivotally coupled to each other at opposing first and second pivot points and configured to selectively rotate about and between an open position and a closed position, each structural member having first and second leg portions and a top portion attached to and extending between the first and second leg portions, the first leg portion of the first structural member being pivotally coupled to the first leg portion of the second structural member at the first pivot point, the second leg portion of the first structural member being pivotally coupled to the second leg portion of the second structural member at the second pivot point, wherein the first and second structural members cooperate to define a seating area; and a seat covering positioned across at least a portion of the seating area between the first and second structural members, wherein the seat covering defines a continuous loop extending between the first and second structural members and wrapping around the top portions of the first and second structural members to define a seating surface, the seat covering comprising a first covering material having opposite first and second ends and disposed across the seating area between the first and second structural members and defining a continuous surface that fully covers the seating area and extends between a first side and an opposing second side that extend transversely between the first and second ends, wherein the first end of the first covering material wraps around the first structural member and the second end of the first covering material wraps around the second structural member, wherein the first end is affixed to at least one of the first structural member and a first portion of the first covering material that is spaced from the first end of the first covering material, and the second end of the first covering material is attached to at least one of a portion of the first covering material that is spaced from the second end of the first covering material and the second structural member, and an outer covering material extending across the seating area, wrapping around the top portions of the first and second structural members, and attaching to an underside of the first covering material at first and second attachment points that are spaced from the first structural member and the second structural member, wherein the first covering material and the outer covering material cooperate to form the continuous loop across the seating area and around the structural members.

* * * * *